US008157584B2

(12) United States Patent
Zhou et al.

(10) Patent No.: US 8,157,584 B2
(45) Date of Patent: Apr. 17, 2012

(54) CABLE CONNECTOR ASSEMBLY

(75) Inventors: Yi Zhou, Shenzhen (CN); Xian-Kui Shi, Shenzhen (CN); Chung-Yen Yang, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 83 days.

(21) Appl. No.: 12/829,407

(22) Filed: Jul. 2, 2010

(65) Prior Publication Data

US 2011/0003506 A1 Jan. 6, 2011

(30) Foreign Application Priority Data

Jul. 2, 2009 (CN) ..... 2009 2 0305560

(51) Int. Cl.
*H01R 13/60* (2006.01)

(52) U.S. Cl. ..... 439/541.5; 439/540.1

(58) Field of Classification Search ..... 439/541.5, 439/540.1
See application file for complete search history.

(56) References Cited

U.S. PATENT DOCUMENTS

| | | | | |
|---|---|---|---|---|
| 5,822,182 | A * | 10/1998 | Scholder et al. | 361/679.57 |
| 6,722,924 | B1 * | 4/2004 | Zhou et al. | 439/607.23 |
| 7,118,414 | B2 * | 10/2006 | Spears et al. | 439/540.1 |
| 7,200,002 | B2 * | 4/2007 | Peng et al. | 361/679.4 |
| 7,315,444 | B2 * | 1/2008 | Chen et al. | 361/679.55 |
| 7,503,802 | B2 * | 3/2009 | Tu et al. | 439/540.1 |
| 7,806,772 | B2 * | 10/2010 | Frost et al. | 464/144 |

FOREIGN PATENT DOCUMENTS

TW M346200 12/2008

* cited by examiner

*Primary Examiner* — Truc Nguyen
(74) *Attorney, Agent, or Firm* — Wei Te Chung; Andrew C. Cheng; Ming Chieh Chang

(57) ABSTRACT

A cable connector assembly includes an insulative housing, a number of connectors retained in the insulative housing and a number of cables retained at a rear side of the insulative housing to electrically connect with the connectors. The insulative housing defines a plurality of first cavities and a second cavity arranged in a row along a transverse direction thereof, and a third cavity at an upper side of the second cavity. The second cavity defines a height which is larger than a width thereof. The connectors include a number of standard USB connectors retained in the first cavities, a lower Audio jack uprightly retained in the second cavity and an upper Audio jack horizontally retained in the third cavity.

17 Claims, 5 Drawing Sheets

CABLE CONNECTOR ASSEMBLY

BACKGROUND OF THE INVENTION

1. Field of the Invention

The present invention relates to cable connector assembly, more particularly to cable connector assembly with a small volume.

2. Description of Related Art

Nowadays, a plurality of connectors, such as Universal Serial Bus (USB) connector, Audio jack, Print ports et al, are set in computers for transmitting data signals. In general, the connectors are arranged at a rear side of the computers for preventing a mating connector from being hit and departed from the connectors, and consumers must turn the computer to front for inserting the mating connector and return the computer when the connectors are inserted completely, which is inconvenient to consumers when some connectors are inserted frequently.

For solving the above problems, some computer designers design a computer with some connectors which are used frequently, such as Universal Serial Bus (USB) connectors and Audio jacks, at a front side thereof. Usually, a computer is designed with at least four USB connectors and two audio jacks, and the four USB connectors and two Audio jacks are horizontally arranged in a row along a transverse direction of the computer. However, with the miniature development of the electrical industry, the computer has a limit width which can not hold four horizontal USB connectors and two Audio jacks along the transverse direction.

Hence, an improved cable connector assembly with small volume is desired to overcome the above problems.

BRIEF SUMMARY OF THE INVENTION

According to one aspect of the present invention, A cable connector assembly comprises: an insulative housing defines a plurality of first cavities and a second cavity arranged in a row along a transverse direction thereof, and a third cavity at an upper side of the second cavity, the second cavity defining a height which is larger than a width thereof; a plurality of connectors retained in the cavities, the connectors comprising a plurality of standard USB connectors retained in the first cavities, a lower Audio jack uprightly retained in the second cavity and an upper Audio jack horizontally retained in the third cavity; and a plurality of cable retained at a rear side of the insulative housing to electrically connect with the connectors.

According to another aspect of the present invention, A cable connector assembly comprises: a plurality of connectors retained with each other, the connectors comprising a plurality of USB connectors arranged in a row along a transverse direction and a pair of Audio jacks stacked with each other along an up to down direction, the Audio jacks being perpendicular to each other; and a plurality of cables electrically connecting with the connectors and located at a rear side of the connectors.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
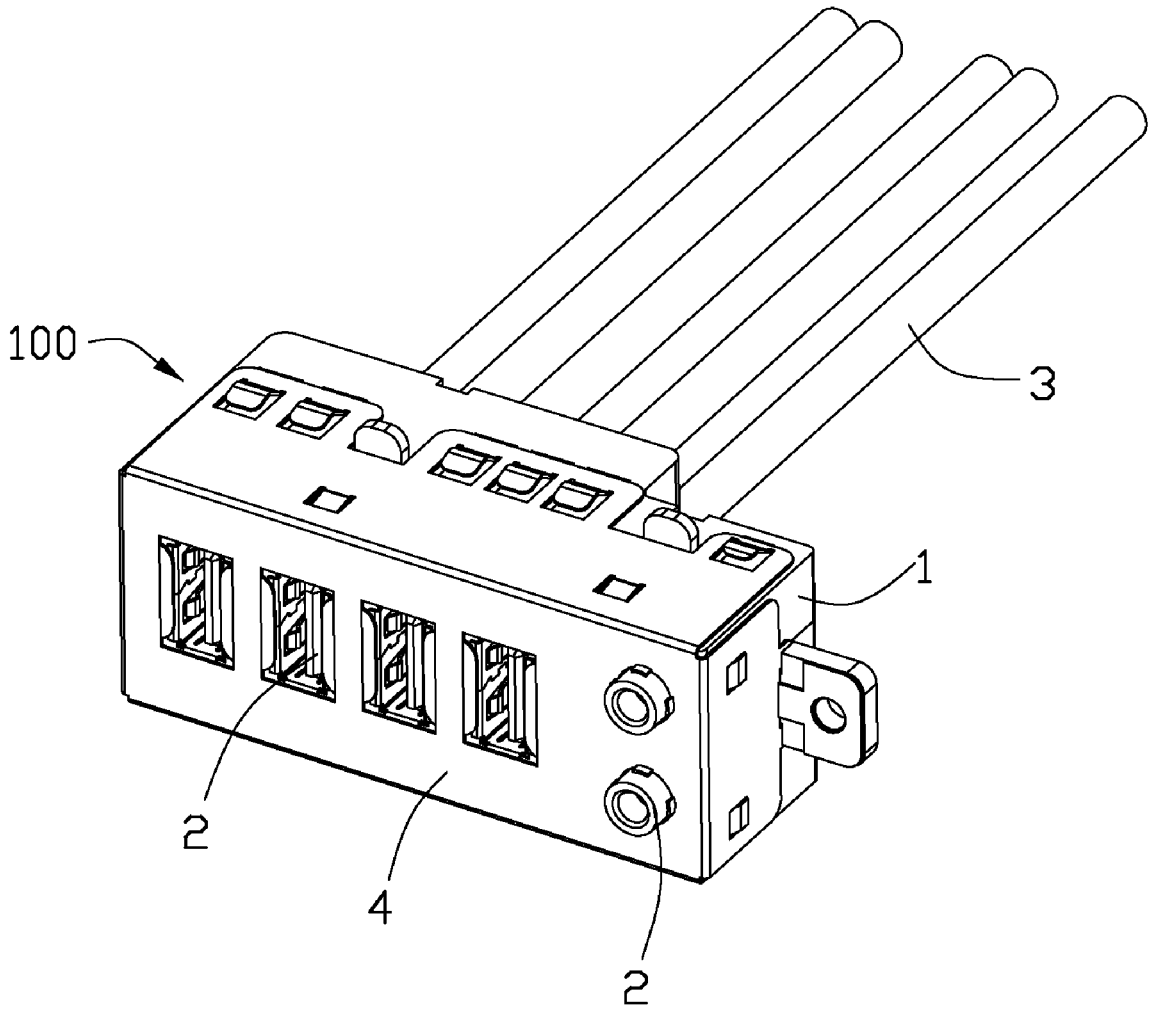
FIG. 1 is a perspective view of a cable connector assembly according to the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Figure 2:
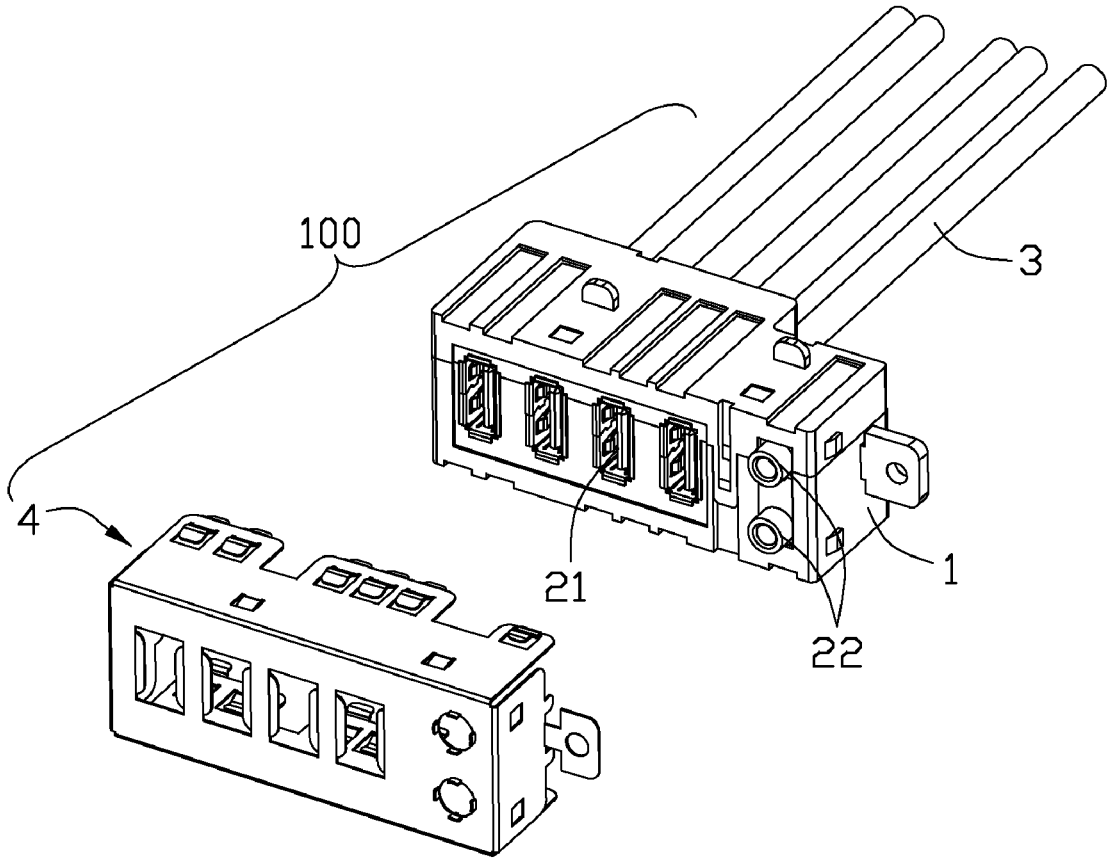
FIG. 2 is a partially perspective view of the cable connector assembly with a metal shell being separated therefrom.
Figure 3:
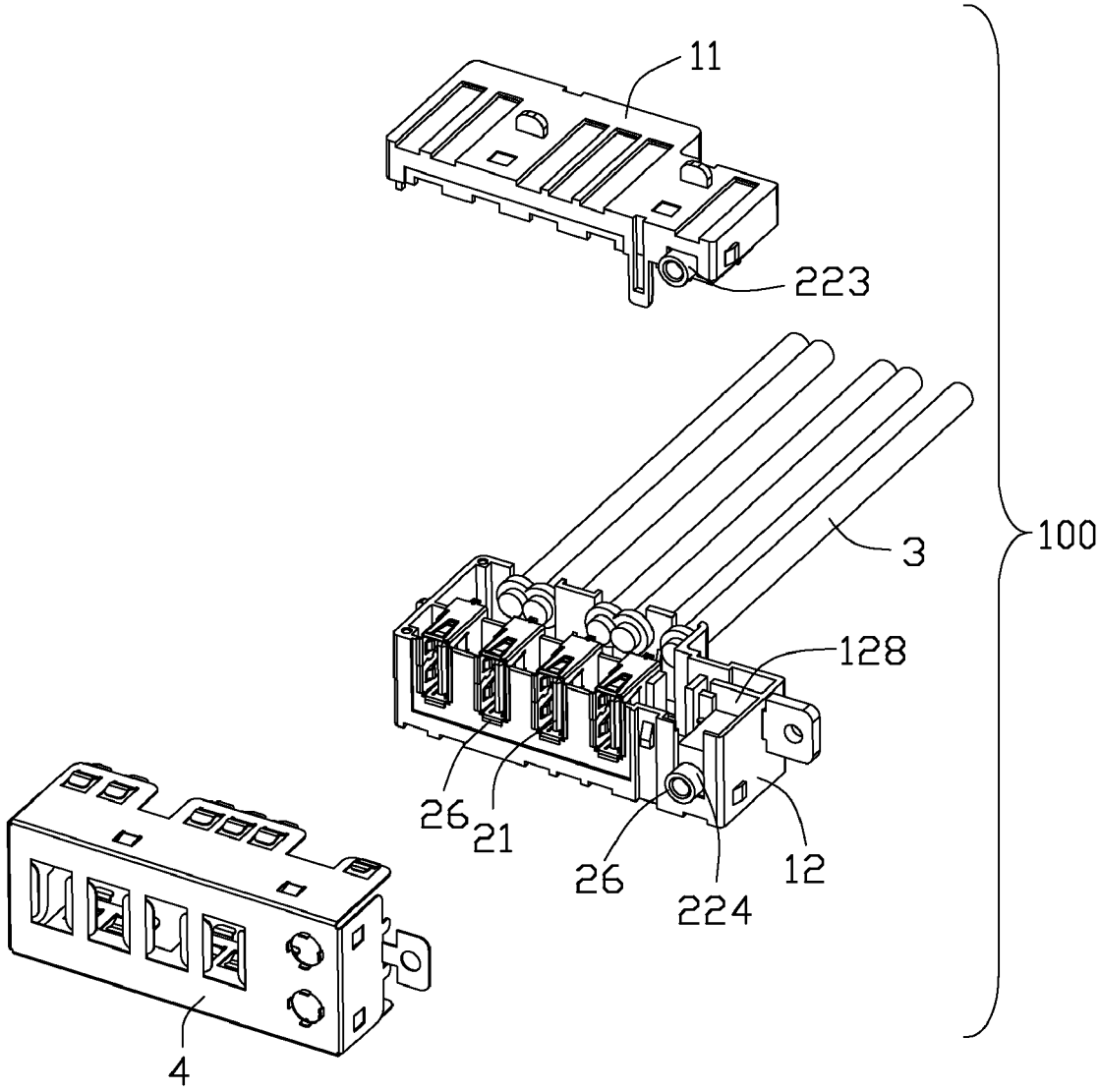
FIG. 3 is a partially perspective view of the cable connector assembly with the metal shell and an upper housing being separated therefrom.
Figure 4:
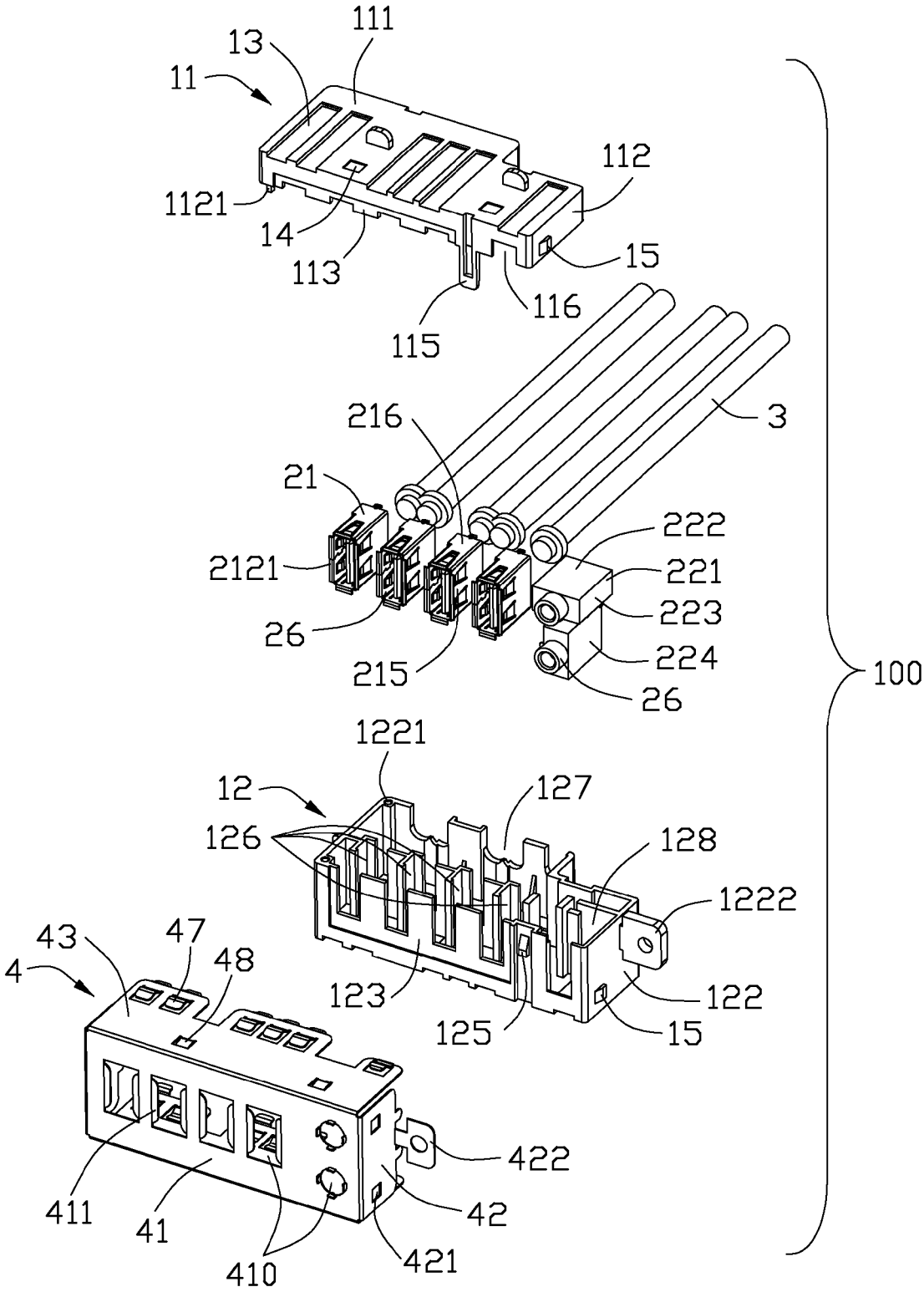
FIG. 4 is an exploded view of the cable connector assembly.
Figure 5:
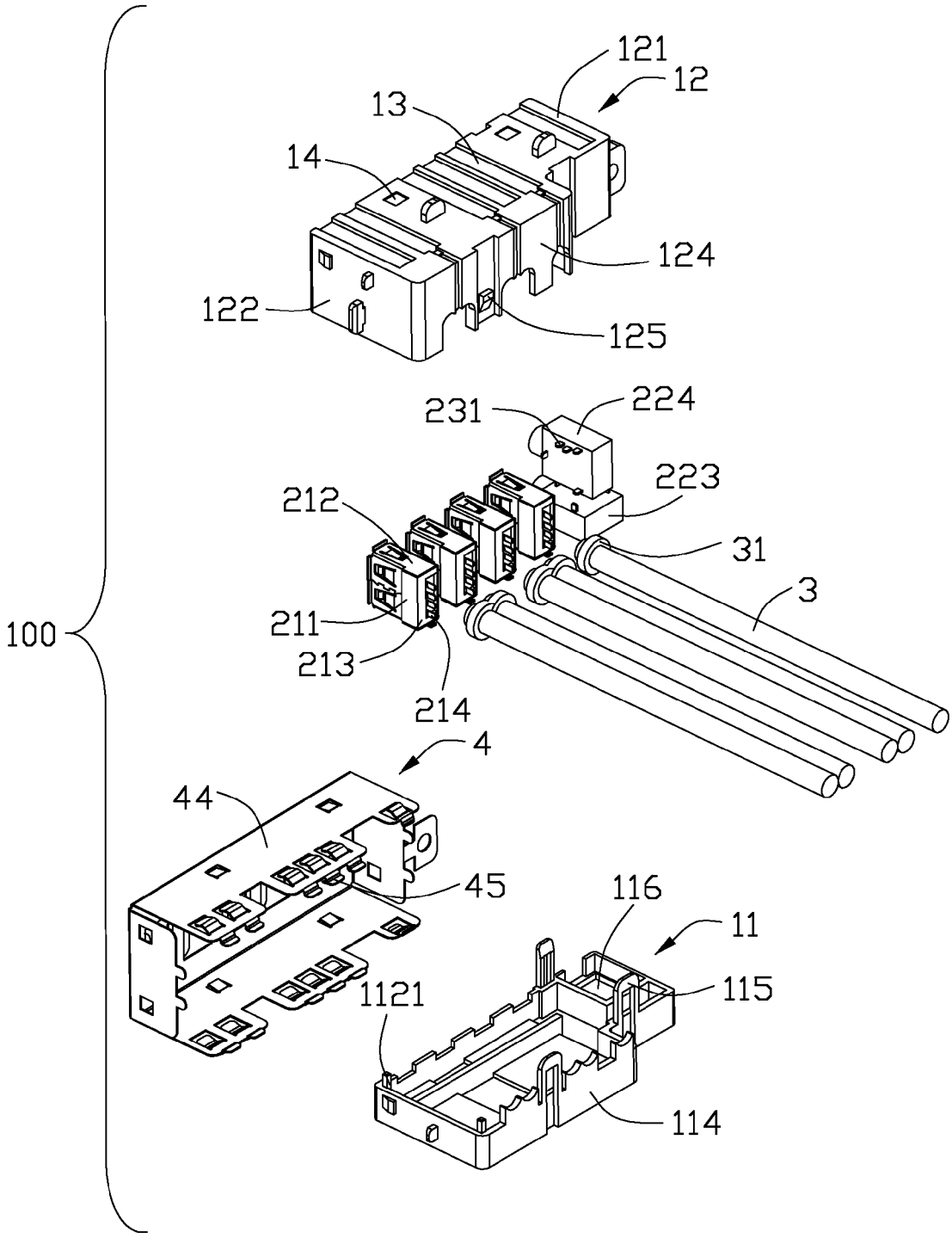
FIG. 5 is a view similar to FIG. 4, while taken from a different aspect.

Referring to FIGS. 1-5, a cable connector assembly 100 according to the present invention comprises an insulative housing 1, a plurality of connectors 2 retained in the insulative housing 1, a plurality of cables 3 connected with the connectors 2 and an outer shell 4 covering the insulative housing 1.

The insulative housing 1 consists of an upper housing 11 and a lower housing 12 retained with each other along an up to down direction. The upper housing 11 has a top wall 111, a pair of first side walls 112 at two sides thereof, and a first front wall 113 and a first rear wall 114 at front and rear sides thereof respectively. The lower housing 12 has a bottom wall 121, a pair of second side walls 122 at two sides thereof and corresponding to the first side walls 112 along the up to down direction, and a second front wall 123 and a second rear wall 124 at front and rear sides thereof and aligned to the first front wall 113 and the first rear wall 112 along the up to down direction respectively.

The lower housing 12 defines a left part and a right part adjacent to each other along the transverse direction. The left part defines a plurality of first cavities 126 opening upwardly and forwardly, and a plurality of openings 127 at the second rear wall 124 for retaining the cables 3. The first cavities 126 are arranged in a row along a transverse direction of the insulative housing 1. The openings 127 communicate with the first cavities 126 along the front to back direction thereof. The right part defines a second cavity 128 opening upwardly and forwardly. The upper housing 11 defines a third cavity 116 opening downwardly and forwardly. The third cavity 116 is aligned to the second cavity 128 and communicates with the second cavity 128 along the up to down direction.

The top wall 111 and bottom wall 121 each defines a plurality of slots 13 extending along a front to back direction and arranged in a row along a transverse direction of the insulative housing 1, and a pair of recesses 14 between the slots 13. The first front wall 113 and the first rear wall 114 are formed with a plurality of latches 115 extending downwardly from a lower end thereof. The second front wall 123 and the second rear wall 124 are formed with a plurality of projections 125 to lock with the latches 115. The first side walls 112 and the second side walls 122 has a plurality of protrusions 15 extending outwardly to lock with the outer shell 4. One of the first side wall 112 has a pair of posts 1121 extending downwardly from a lower end thereof. One of the second side wall 122 defines a pair of holes 1221 to engage with the posts 1121, and another second side wall 122 is formed with an ear portion 1222 extending outwardly to lock with the outer shell 4.

Referring to FIGS. 1-5, the connectors 2 comprise four USB connectors 21 and two Audio jacks 22. Each connector 2 has a mating end 26 forwardly extending out of the first cavity 126 and a connecting end connecting with the cable 3. Each USB connector 21 has a contact module 211 and an inner shell 212 covering the contact module 211. Each inner shell 212 has a plurality of flanges 2121 extending outwardly from a front end thereof. The contact module 211 comprises a housing 213 and a plurality of contacts 214 retained in the housing 213 and extending out of the housing 213 to electrically connect with the cable 3. Each USB connector 21 has a pair of first side surfaces 215 parallel to a tongue thereof and a pair of second side surfaces 216 between the first side surfaces 215. The second side surfaces 216 are narrower than the first side surface 211. All the USB connectors 21 are downwardly assembled into the first cavities 126 from a top end of the lower housing 12, and uprightly retained in the first cavities 126. Thereby the first side surfaces 215 are parallel to the side walls 112, 122, and the second side surfaces 216 are parallel to the bottom wall 121 for making the four USB connectors 21 occupy a small area of the bottom wall 121, which can decrease a width of the cable connector assembly 100.

The Audio jacks 22 are flat for decreasing a height thereof and manufacture material. The Audio jacks 22 are stacked with each other along the up to down direction, thereby the Audio jacks 22 comprise an upper Audio jack 223 and a lower Audio Jack 224. Each Audio jack 22 has a pair of third side surfaces 221 and a pair of fourth side surfaces 222 between the third side surfaces 221. The fourth side surfaces 222 are narrower than the third side surfaces 221. The lower Audio jack 224 is downwardly assembled into the second cavity 128 from the top end of the lower housing 12 and uprightly retained in the second cavity 128. The third side surfaces 221 of the lower Audio jack 224 are parallel to the side walls 112, 122, and the fourth side surfaces 222 of the lower Audio jack 224 are parallel to the bottom wall 121 for decreasing the width of the cable connector assembly 100. Thereby the USB connectors 21 are parallel to the lower Audio jack 224.

The upper Audio jack 223 is upwardly assembled into the third cavity 116 from a lower end of the upper housing 11 and horizontally retained in the third cavity 116. The third side surfaces 221 of the upper Audio jack 223 are parallel to the top wall 111, and the fourth side surfaces 222 are parallel to the side walls 112, 122. Then when the upper housing 11 and lower housing 12 are retained with each other, the upper Audio jack 223 is perpendicular to the lower Audio jack 224 and presses a top end of the lower Audio jack 224 for preventing the lower Audio jack 224 from moving upwardly, besides, a distance between the mating ends 26 of the two Audio jacks 22 can be increased for simultaneously inserting two Audio plugs (not shown) into the mating ends 26. The mating ends 26 of the two Audio jacks 22 are aligned with each other along the up to down direction. In addition, a front surface of the upper Audio jack 223 is located at a rear side of a front surface of the lower Audio jack 224, and the mating ends 26 of the Audio jacks 22 extend from the front surface thereof. Finally, the insulative housing 1 just comprises the upper and lower housings 11, 12 to retain the connectors 2 together, which make the cable connector assembly 100 of the present invention has a simple structure and be assembled conveniently.

The cable 3 has a retaining portion 31 protruding outwardly at a front side thereof. The retaining portion 31 locks with an inner side of the second rear wall 124 for preventing the cable 3 from being pulled to be separated from the insulative housing 1. Each cable 3 has a plurality of wires (not shown) therein for electrically connecting with the contacts 214.

The outer shell 4 is stamped by a metal sheet. The outer metal shell 4 has a front wall 41 covering a front side of the insulative housing 1, a pair of side walls 42 extending backwardly from two sides of the front wall 41, and an upper wall 43 and a lower wall 44 extending backwardly from upper and lower ends of the front wall 41. The front wall 41 defines a plurality of hollows 410 extending therethrough and corresponding to the cavities 126, 128, 116, and a plurality of tabs 411 extending backwardly from an inner edge of the hollows 410 to contact with the flanges 2121 and the mating ends 26 of the Audio jacks 22 for grounding. The upper and lower walls 43, 44 are formed with a plurality of retaining strips 45 at a rear end thereof to engage with a rear end of the slots 13 of the insulative housing 1, a plurality of springs 47 extending outwardly to engage with a shell of computer (not shown), and two pairs of barbs 48 extending inwardly to engage with the recesses 14. The side walls 42 defines a plurality of locking holes 421 extending therethrough to lock with the projections 125 of the insulative housing 1. The outer shell 4 has a metal ear 422 extending outwardly from a rear end of one side wall 42 to joint with the ear portion 1222 of the insulative housing 1.

As fully described above, the USB connectors 21 and the flat lower Audio jack 224 are slim and uprightly retained in the insulative housing 1, therefore, the cable connector assembly 100 of the present invention has a small width and merely occupies a small area of the computer along a transverse direction thereof. Besides, the flat upper Audio jack 223 is perpendicular to the flat lower Audio jack 224, which make the distance between two front mating ports 225 of the two Audio jacks 22 be increased for simultaneously inserting two Audio plugs (not shown) into the mating ends 26. In addition, the insulative housing 1 in the present invention consists of the upper housing 11 and the lower housing 12, which make the cable connector assembly 100 has a simple structure and is assembled conveniently. Finally, the upper Audio jack 223 is fat and has a small height, which can decrease a height of the cable connector assembly 100.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A cable connector assembly comprising:

an insulative housing defining a plurality of first cavities and a second cavity arranged in a row along a transverse direction thereof, and a third cavity at an upper side of the second cavity, the second cavity defining a height which is larger than a width thereof;

a plurality of connectors retained in the cavities, the connectors comprising a plurality of standard USB connectors retained in the first cavities, a lower Audio jack uprightly retained in the second cavity and an upper Audio jack horizontally retained in the third cavity; and a plurality of cable retained at a rear side of the insulative housing to electrically connect with the connectors;

wherein the third cavity communicates with the second cavity along an up to down direction, and the upper Audio jack downwardly presses the lower Audio jack to prevent the lower Audio jack moving along the up to down direction;

wherein the Audio jacks are flat, and each Audio jack has a pair of parallel third side surfaces and a pair of parallel fourth side surfaces between the third side surfaces, and the third side surface defines a width which is larger than that of the fourth side surface, the third side surfaces of the upper Audio jack are perpendicular to the third side surfaces of the lower Audio jack;

wherein the insulative housing consists of an upper housing and a lower housing retained with each other along the up to down direction, and the first and second cavities are formed in the lower housing, and the third cavity is formed in the upper housing.

2. The cable connector assembly as claim in claim 1, wherein the third cavity defines a width which is wider than the width of the second cavity along the transverse direction.

3. The cable connector assembly as claimed in claim 1, wherein the first and second cavities open upwardly and forwardly, and the USB connectors and the lower Audio jack are downwardly assembled into the first and second cavities respectively, the USB connectors are uprightly retained in the first cavities respectively and parallel to the lower Audio jack.

4. The cable connector assembly as claimed in claim 3, wherein the third cavity opens downwardly and forwardly, and the upper Audio jack is upwardly assembled into the third cavity.

5. The cable connector assembly as claimed in claim 1, wherein the insulative housing defines a plurality of openings at a rear side thereof to retain the cables.

6. The cable connector assembly as claimed in claim 1, wherein each USB connector has a contact module and an inner shell covering the contact module, and each inner shell has a plurality of flanges extending outwardly, the cable connector assembly further comprises an outer shell, the outer shell defines a plurality of hollows corresponding to the first, second and third cavities and a plurality of tabs extending backwardly from an inner edge of the hollows to engage with the flanges and a mating end of the Audio jack.

7. A cable connector assembly comprising:

an insulative housing defining a plurality of first cavities and a second cavity arranged in a row along a transverse direction thereof, and a third cavity at an upper side of the second cavity, the second cavity defining a height which is larger than a width thereof;

a plurality of connectors retained with each other, the connectors comprising a plurality of USB connectors arranged in a row along a transverse direction and a pair of upper and lower Audio jacks stacked with each other along an up to down direction, the upper and lower Audio jacks being perpendicular to each other; and a plurality of cables electrically connecting with the connectors and located at a rear side of the connectors;

wherein the third cavity communicates with the second cavity along an up to down direction, and the upper Audio jack downwardly presses the lower Audio jack to prevent the lower Audio jack moving along the up to down direction;

wherein the Audio jacks are flat, and each Audio jack has a pair of parallel third side surfaces and a pair of parallel fourth side surfaces between the third side surfaces, and the third side surface defines a width which is larger than that of the fourth side surface, the third side surfaces of the upper Audio jack are perpendicular to the third side surfaces of the lower Audio jack;

wherein the insulative housing consists of an upper housing and a lower housing retained with each other along the up to down direction, and the first and second cavities are formed in the lower housing, and the third cavity is formed in the upper housing.

8. The cable connector assembly as claimed in claim 7, further comprising an insulative housing retaining all the connectors together.

9. The cable connector assembly as claimed in claim 8, wherein the Audio jacks are located at one side of all the USB connectors along the transverse direction.

10. The cable connector assembly as claimed in claim 9, wherein the Audio jacks comprises an upper Audio jack and a lower Audio jack, the USB connectors are parallel to the lower Audio jack, and perpendicular to the upper Audio jack.

11. The cable connector assembly as claimed in claim 10, wherein the USB connectors and the lower Audio jack are slim and have a larger height, and the upper Audio jack is fat and has a small height.

12. A cable connector assembly comprising:

a housing defining a first dimension along a transverse direction, a second dimension along a height direction perpendicular to said transverse direction, and a third dimension along a front-to-back direction perpendicular to both said transverse direction and said height direction;

a pair of upper and lower of first type connectors arranged in one row in said transverse direction, each of said first type connector being of an upstanding manner in the height direction;

a set of first cable linked to the corresponding first type connectors;

a plurality of second type connectors arranged at one end of said first type connectors in said transverse direction; and a set of second cable linked to the corresponding second type connectors;

the housing forming a cutout around a rear corner behind the second type connectors; wherein both said first set of cable and said second set of cable extend rearwardly out of the housing behind said first type connectors in said front-to-back direction, and offset from the cutout in said transverse direction;

wherein the housing further defining a plurality of first cavities and a second cavity arranged in a row along the transverse direction thereof, and a third cavity at an upper side of the second cavity, the second cavity defining a height which is larger than a width thereof;

wherein the third cavity communicates with the second cavity along an up to down direction, and the upper of first type connector downwardly presses the lower first type connector to prevent the lower first type connector moving along the up to down direction;

wherein the first type connectors are flat, and each first type connector has a pair of parallel third side surfaces and a pair of parallel fourth side surfaces between the third side surfaces, and the third side surface defines a width which is larger than that of the fourth side surface, the third side surfaces of the upper first type connector are perpendicular to the third side surfaces of the lower first type connector;

wherein the housing consists of an upper housing and a lower housing retained with each other along the up to down direction, and the first and second cavities are formed in the lower housing, and the third cavity is formed in the upper housing.

13. The cable connector assembly as claimed in claim 12, wherein the housing is equipped with a screw hole structure at one end along said transverse direction proximate said cutout for fastening.

14. The cable connector assembly as claimed in claim 12, wherein said second type connectors are arranged in a height direction.

15. The cable connector assembly as claimed in claim 14, wherein said second type connectors includes one in an upstanding manner and another in a horizontal manner.

16. The cable connector assembly as claimed in claim 12, wherein the housing includes upper and lower parts having means for assembling together, and said means is located at a position between a first region occupied by the first type connectors and a second region occupied by the second type connectors in said transverse direction.

17. The cable connector assembly as claimed in claim 12, further including a metallic shell enclosing the housing, wherein said shell defines another screw hole structure abutting against he screw hole structure in said front-to-back direction.

* * * * *